US008200126B2

(12) United States Patent
Chaudhuri et al.

(10) Patent No.: US 8,200,126 B2
(45) Date of Patent: Jun. 12, 2012

(54) TONER CARTRIDGES FOR AN IMAGE FORMING DEVICE

(75) Inventors: Akash Chaudhuri, Lexington, KY (US); Jedediah Taylor Dawson, Lexington, KY (US); Jarrett Clark Gayne, Lexington, KY (US); Darin Michael Gettelfinger, Lexington, KY (US); Matthew Thomas Kerley, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1112 days.

(21) Appl. No.: 11/948,104

(22) Filed: Nov. 30, 2007

(65) Prior Publication Data

US 2009/0142103 A1 Jun. 4, 2009

(51) Int. Cl.
*G03G 15/08* (2006.01)

(52) U.S. Cl. ..... 399/262

(58) Field of Classification Search ..... 399/107, 399/110, 119, 258, 260, 262
See application file for complete search history.

(56) References Cited

U.S. PATENT DOCUMENTS

| | | | | |
|---|---|---|---|---|
| 4,824,388 | A | | 4/1989 | Pickel |
| 4,839,691 | A | | 6/1989 | Tagawa et al. |
| 4,891,017 | A | | 1/1990 | Kuhn et al. |
| 5,002,497 | A | | 3/1991 | Plocek et al. |
| 5,259,779 | A | | 11/1993 | Ooya et al. |
| 5,300,991 | A | * | 4/1994 | Hiraike |
| 5,392,371 | A | | 2/1995 | Morlion et al. |
| 5,490,802 | A | | 2/1996 | Plyler et al. |
| 5,506,665 | A | * | 4/1996 | Ishida et al. ..... 399/119 |
| 5,519,422 | A | * | 5/1996 | Thoman et al. |
| 5,605,150 | A | | 2/1997 | Radons et al. |
| 5,746,617 | A | | 5/1998 | Porter, Jr. et al. |
| 5,798,777 | A | * | 8/1998 | Yoshimura et al. |
| 5,907,748 | A | | 5/1999 | Kawana |
| 5,946,531 | A | | 8/1999 | Miura et al. |
| 6,014,533 | A | | 1/2000 | Kawana |
| 6,059,599 | A | | 5/2000 | Huang |
| 6,097,908 | A | | 8/2000 | Uchiyama et al. |
| 6,102,533 | A | * | 8/2000 | Nozawa et al. |
| 6,168,262 | B1 | * | 1/2001 | Clark et al. |

(Continued)

FOREIGN PATENT DOCUMENTS

JP 2004264757 A * 9/2004

(Continued)

OTHER PUBLICATIONS

Dawson et. al., "Electrical Connectors for Toner Cartridges in an Image Forming Device." Apr. 2, 2007, 23 pages, U.S. Appl. No. 11/695,355.

(Continued)

*Primary Examiner* — David Porta
*Assistant Examiner* — Milton Gonzalez
(74) *Attorney, Agent, or Firm* — John Victor Pezdek; Justin M Tromp

(57) ABSTRACT

A toner cartridge for use with image forming devices according to one example embodiment includes an interior to contain toner that is transferred to the image forming device and used during image formation and includes one or more engagement features that interact with the image forming device during insertion. The engagement features may include one or more alignment features that align the cartridge during insertion into the image forming device. The engagement features may also include one or more functional features that allow the cartridge to effectively transfer the toner to the image forming device.

21 Claims, 18 Drawing Sheets

U.S. PATENT DOCUMENTS

| | | | | |
|---|---|---|---|---|
| 6,186,809 | B1 | 2/2001 | Kung | |
| 6,254,408 | B1 | 7/2001 | Hattori et al. | |
| 6,315,590 | B1 | 11/2001 | Grois et al. | |
| 6,349,182 | B2 | 2/2002 | Otsubo et al. | |
| 6,398,587 | B1 | 6/2002 | Chen et al. | |
| 6,582,039 | B2 | 6/2003 | Johnson et al. | |
| 6,773,283 | B2 | 8/2004 | Yoshimatsu et al. | |
| 6,786,590 | B2 | 9/2004 | Maki et al. | |
| 6,786,750 | B2 | 9/2004 | Itoh | |
| 6,848,925 | B2 | 2/2005 | Nishide | |
| 6,969,148 | B2 * | 11/2005 | Sturgeon et al. | |
| 7,074,084 | B2 | 7/2006 | Shuey et al. | |
| 7,258,558 | B1 | 8/2007 | Dawson et al. | |
| 7,272,336 | B1 | 9/2007 | Dawson et al. | |
| 2002/0025725 | A1 | 2/2002 | Ushio et al. | |
| 2003/0035016 | A1 | 2/2003 | Tanaka | |
| 2005/0008400 | A1 * | 1/2005 | Tazawa et al. | |
| 2005/0117919 | A1 | 6/2005 | Ito et al. | |
| 2005/0169672 | A1 * | 8/2005 | Ban et al. | 399/258 |
| 2006/0104673 | A1 * | 5/2006 | Sasae et al. | 399/262 |
| 2006/0171744 | A1 * | 8/2006 | Ikeda et al. | 399/262 |
| 2007/0077101 | A1 * | 4/2007 | Tamura et al. | 399/262 |
| 2007/0223941 | A1 * | 9/2007 | Dawson | |
| 2008/0107453 | A1 * | 5/2008 | Dawson | 399/260 |
| 2008/0145110 | A1 * | 6/2008 | Dawson et al. | 399/262 |

FOREIGN PATENT DOCUMENTS

| | | | |
|---|---|---|---|
| JP | 2006154276 A | * | 6/2006 |

OTHER PUBLICATIONS

Dawson et. al., "Electrical Connectors for Toner Cartridges in an Image Forming Device." Jan. 22, 2007, 23 pages, U.S. Appl. No. 11/625,620.

Dawson et. al., "Electrical Connectors for Toner Cartridges in an Image Forming Device." Oct. 30, 2006, 25 pages, U.S. Appl. No. 11/554,117.

Dawson et. al., "Cartridge with a Movable Electrical Connector for Use with an Image Forming Device." Oct. 30, 2006, 24 pages, U.S. Appl. No. 11/554,157.

Dawson et. al., "Cartridge with a Movable Electrical Connector for Use with an Image Forming Device." Jan. 22, 2007, 23 pages, U.S. Appl. No. 11/625,525.

International Search Report and Written Opinion of the International Searching Authority for PCT Application No. PCT/US08/85182, which claims priority to the present application, dated Jan. 29, 2009 (8 pages).

* cited by examiner

TONER CARTRIDGES FOR AN IMAGE FORMING DEVICE

BACKGROUND

The present application is directed to cartridges for use with image forming devices and, more particularly, to a cartridge with one or more engaging features that engage with the image forming device during insertion.

Toner cartridges contain a predetermined amount of toner. The cartridges are constructed to be inserted into and engage with the image forming device. This engagement provides for the toner in the cartridge to be transferred into the image forming device and ultimately to a media sheet during the image formation process. The engagement between the cartridge and image forming device is important to ensure the cartridge operates properly within the image forming device to transfer the toner.

The cartridge should be constructed to prevent toner leakage prior to insertion into the device, and after insertion into the device. The cartridge may include a closure mechanism that prevents the toner from escaping prior to insertion into the image forming device. During insertion, the cartridge should engage with the image forming device in a manner to move the closure mechanism from a closed position to an open position that allows the toner to move from the cartridge and into the image forming device.

The cartridge should be carefully aligned relative to the image forming device to ensure accurate insertion that prevents toner leakage. The cartridge may include one or more engagement features that engage with the image forming device that provide accurate alignment. The engagement features may be positioned at various locations on the body of the cartridge.

SUMMARY

The present application is directed to toner cartridges for use with image forming devices. The cartridge may include an interior to contain toner that is transferred to the image forming device and used during image formation. The cartridge may include one or more engagement features that interact with the image forming device during insertion. The engagement features may include one or more alignment features that align the cartridge during insertion into the image forming device. The engagement features may also include one or more functional features for the cartridge to effectively transfer the toner to the image forming device.

DETAILED DESCRIPTION

Figure 1:
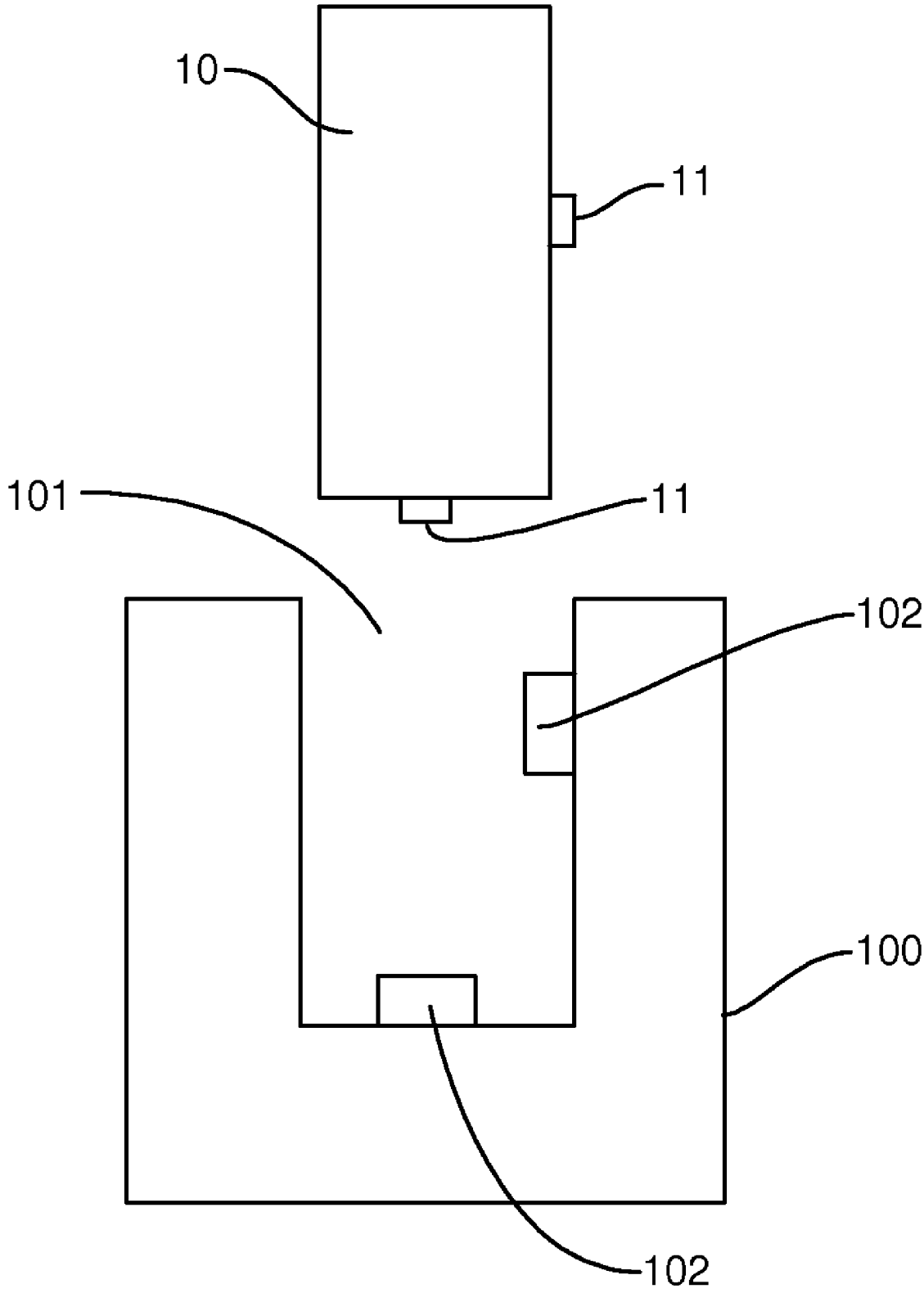
FIG. 1 is a schematic diagram of a toner cartridge and an image forming device according to one embodiment.

The present application is directed to toner cartridges for use within image forming devices. FIG. 1 schematically illustrates one embodiment that includes a toner cartridge 10 with one or more engagement features 11. The image forming device 100 includes a receiving area 101 sized to receive the cartridge 10. One or more engagement features 102 are associated with the image forming device 100. The engagement features 11 on the cartridge 10 interact with the engagement features 102 on the image forming device 100 during insertion of the cartridge 10 into the receiving area 101. The engagement features 11, 102 may perform a variety of functions, including positioning the cartridge 10 within the image forming device 100, causing toner within the cartridge 10 to move into the image forming device 100, allowing the cartridge 10 to communicate with the image forming device 100, providing power from the image forming device 100 to the cartridge 10, and others. The engagement features 11, 102 are positioned such that the various functions are performed in an orchestrated manner during insertion of the cartridge 10.

Figure 2:
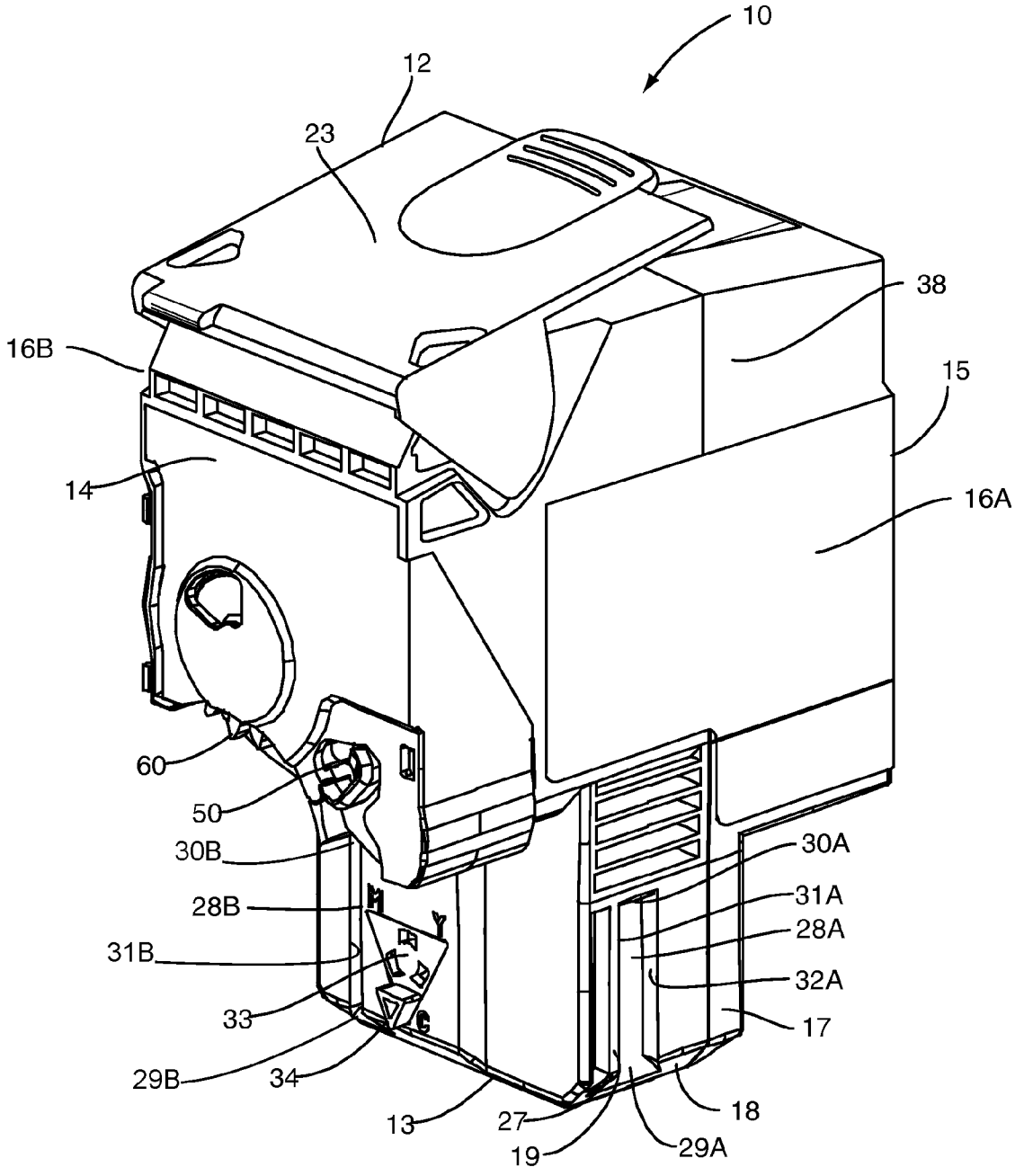
FIG. 2 is a perspective view of a first side of a cartridge according to one embodiment.
Figure 3:
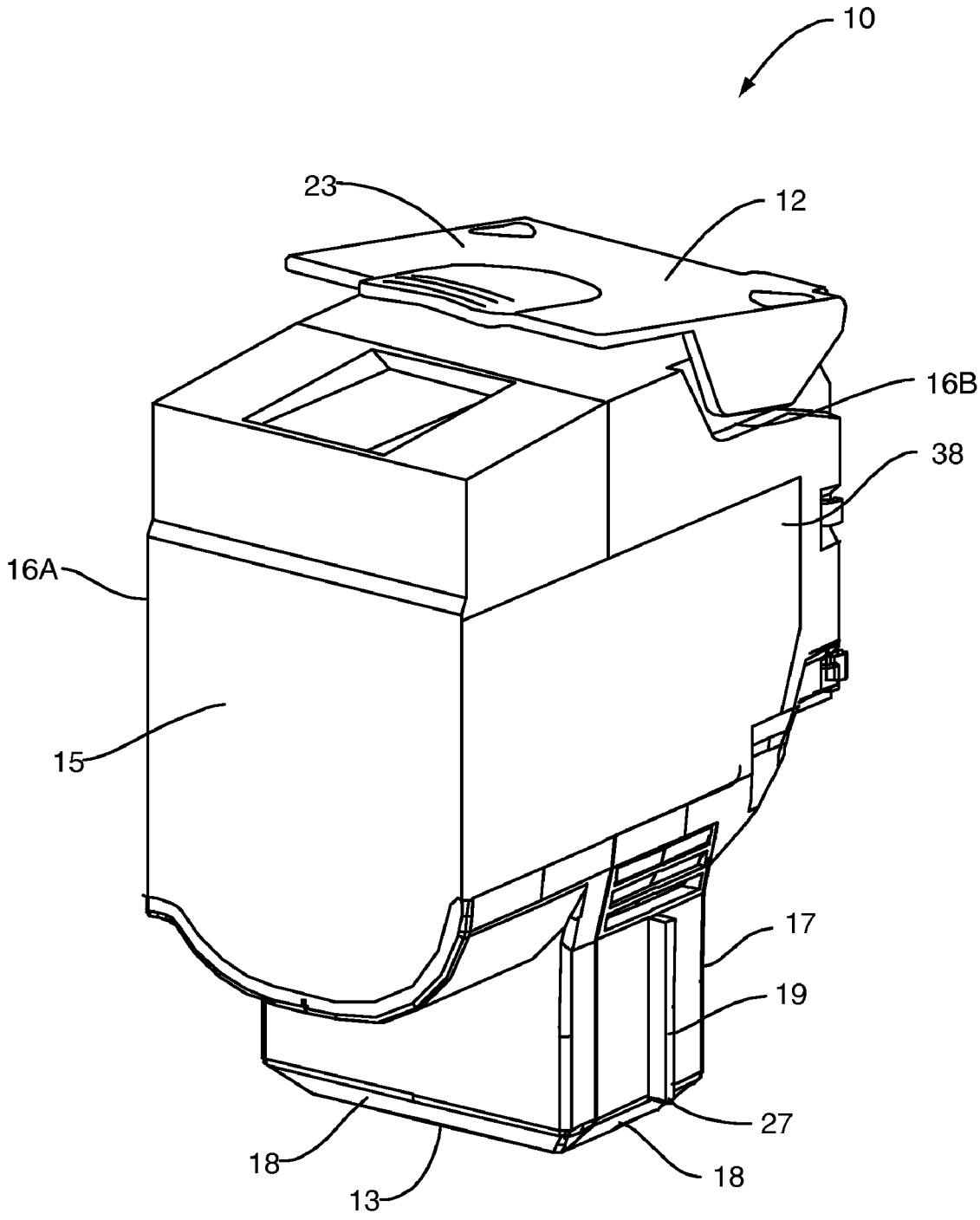
FIG. 3 is a perspective view of a second side of a cartridge according to one embodiment.
Figure 4:
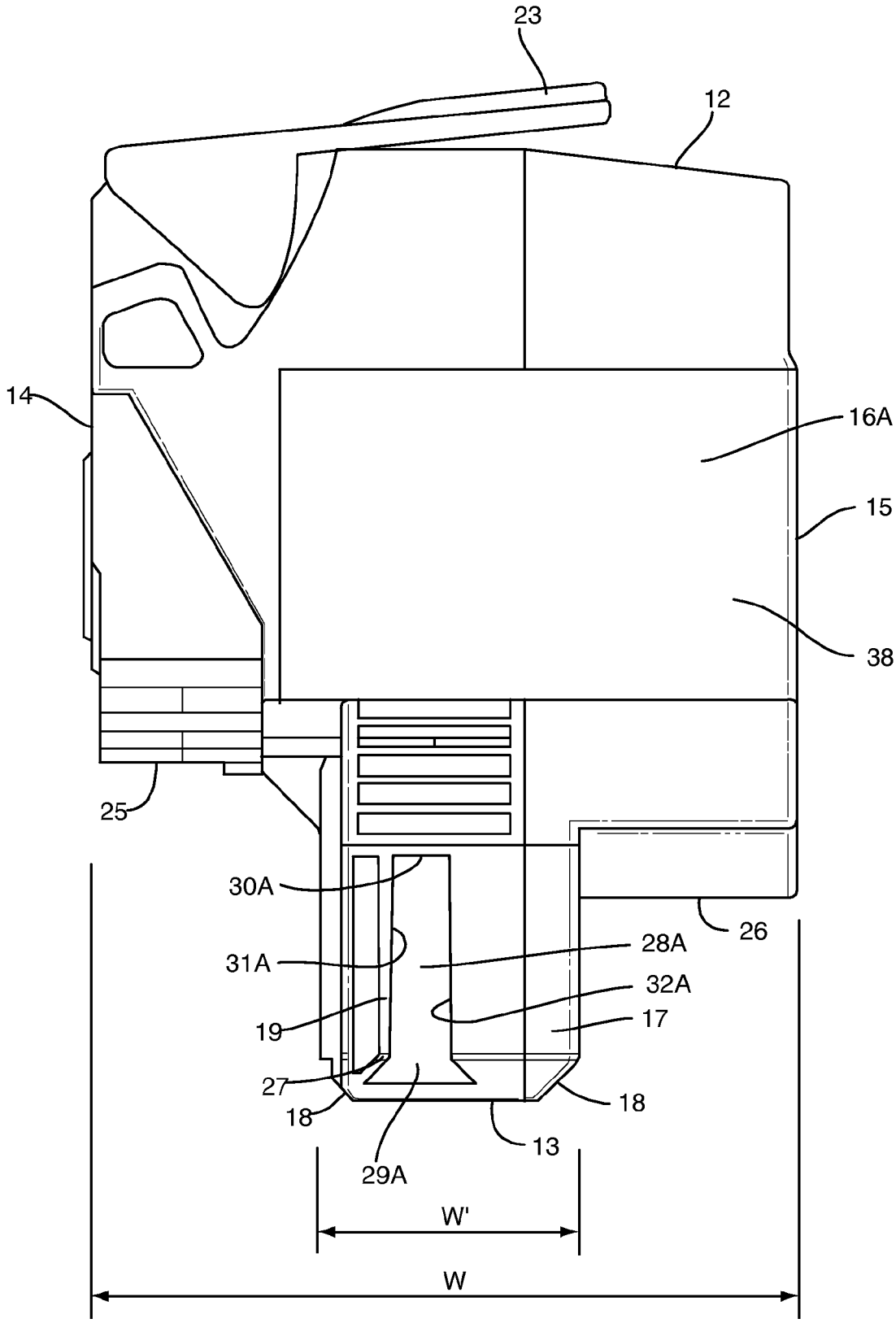
FIG. 4 is a side view of a cartridge according to one embodiment.

FIGS. 2, 3, and 4 illustrate one embodiment of a cartridge 10. The cartridge 10 contains toner that is transferred to the image forming device 100. The cartridge 10 includes a top 12, bottom 13, front 14, back 15, and first and second sides 16A, 16B. A handle 23 may be attached to the top 12 to facilitate grasping and manipulating the cartridge 10 during insertion and removal from the image forming device 100. In one embodiment, the handle 23 is pivotally attached to the cartridge 10.

Cartridge 10 includes a main section 38 and an extension 17. The extension 17 is positioned at the bottom 13 of the cartridge 10. As illustrated in FIG. 4, a depth W' of the extension 17 measured between the front 14 and back 15 is smaller than a depth W of the main section 38 of the cartridge 10. In one embodiment, the extension 17 is positioned at a central point of the main section 38 forming a front shelf 25 and a back shelf 26. In one embodiment, the front and back shelves 25, 26 are substantially perpendicular to the extension 17. The cartridge 10 includes an overall height measured between the top 12 and the bottom 13. The extension 17 includes a smaller height than the main section 38.

One or more of the engagement features 11 align the cartridge 10 during insertion into the image forming device 100. Many of these are located on the extension 17 because the extension 17 is initially inserted into the device 100 during a vertical insertion of the cartridge 10. One engagement features 11 includes chamfers 18 that are positioned on the bottom 13. Chamfers 18 may be positioned on a single side or multiple sides of the extension. In one embodiment, the extension includes a substantially rectangular cross-sectional shape and chamfers 18 are positioned along each of the four edges.

Another engagement feature 11 for alignment includes one or more ribs 19 that extend in a substantially vertical orientation along the extension 17. In one embodiment, the ribs 19 include a leading end 27 that faces towards the bottom 13. In one embodiment, the leading end 27 is spaced away from the chamfer 18 and makes contact with the device 100 after contact is made by the chamfer 18. The leading end 27 may include a chamfer, or may extend substantially perpendicularly outward from the extension 17. The length may vary, with the embodiment illustrated including the ribs 19 extending along the length of the extension 17. In this embodiment, ribs 19 are positioned on each of the first and second lateral sides 16A, 16B, although other embodiments may include positioning at other locations. In embodiments with multiple ribs 19, the ribs 19 may include the same or different shapes and sizes. In one embodiment, the cartridge 10 includes a single rib 19.

Figure 5:
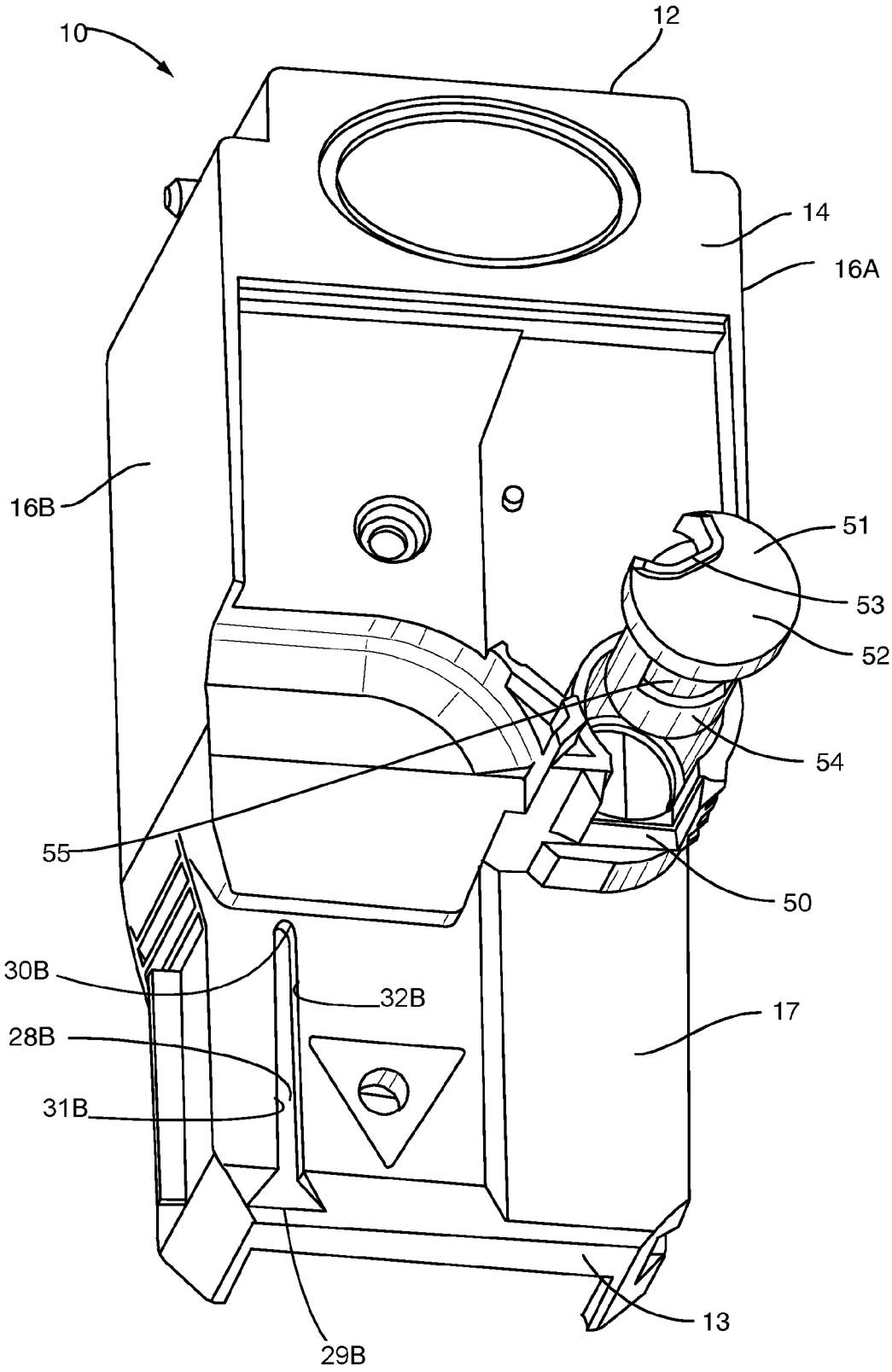
FIG. 5 is an exploded view of a shutter removed from a toner cartridge according to one embodiment.

Another alignment engagement feature 11 includes one or more slots 28A, 28B. Slots 28A, 28B may be positioned at a variety of locations along the cartridge 10, including facing towards the first and side lateral sides 16A and 16B as illustrated in FIGS. 2 and 4. Slots 28A, 28B include respective first ends 29A, 29B that open towards the bottom 13, and respective opposite second ends 30A, 30B. The first ends 29A, 29B may include chamfers forming an enlarged width to facilitate engagement with the image forming device 100 during insertion of the cartridge 10. Slots 28A, 28B further include respective first and second walls 31A, 32A and 31B, 32B. In the embodiment of FIGS. 2, 4 and 5, for slot 28A in first lateral side 16A, the first wall 31A faces towards the back 15 and the second wall 32A towards the front 14 while for slot 28B, walls 31B, 32B face second and first lateral sides 16A, 16B, respectively. The walls 31A, 32A and 31B, 32B may be parallel causing widths of the slots 28A, 28B respectively to be substantially constant. The slots 28A, 28B each may include a height that extends a variety of distances inward from the bottom 13. In the embodiment illustrated in FIGS. 2, 4 and 5, the slots 28A, 28B each are substantially the same height as the rib 19. Further, the slots 28A, 28B may be parallel to the rib 19. In the embodiment illustrated in FIG. 2, slot 28A on the first lateral side 16A of the extension 17 is wider than the slot 28B on the front 14 of the extension 17 (see also FIGS. 4 and 5).

Another alignment engagement feature 11 includes a lockout mechanism 33 to control the location of insertion of the cartridge 10 into the image forming device 100. The lockout mechanism 33 prevents a specific cartridge 10 from being inserted into an incorrect receiving area 101. By way of example, the lockout mechanism 33 may prevent a black toner cartridge 10 from being inserted into a receiving area 101 for a cyan, yellow or magenta cartridge 10. The lockout mechanism 33 may include a pointed first end 34 that faces towards the bottom 13. The pointed first end 34 is positioned above the chamfer 18. In one embodiment, the lockout mechanism 33 is positioned on the front face 14 of the extension 17. One embodiment of a lockout mechanism is disclosed in U.S. Pat. No. 7,813,656, herein incorporated by reference.

The engagement features 11 may also include functional features that cause the cartridge 10 to operate within the image forming device 100 and move the toner to the image forming device 100. One functional engagement feature 11 includes an outlet 50 and shutter 51. Outlet 50 is positioned to allow the toner to be moved from the interior 37 of the cartridge 10. As illustrated in FIG. 5, the outlet 50 is positioned on the front 14 of the cartridge 10. The outlet 50 is formed by an outer wall and may also face towards the bottom 13. The shutter 51 is positioned within the outlet 50 to control the movement of the toner. Shutter 51 is constructed to rotate between a closed position to prevent the movement of toner, and an open position to allow the movement of toner. Shutter 51 may include a face 52 and a tubular body 54. The face 52 is sized to extend across the outlet 50 and be exposed on the front 14 of the cartridge 10. Face 52 includes a notch 53 that contacts with an engagement feature 102 in the image forming device 100 to control rotation of the shutter 51 between the open and closed positions. The body 54 is sized to fit within the outlet 50 and includes a substantially cylindrical shape with a hollow interior. The body 54 further includes an opening 55. In the closed position, the opening 55 is positioned away from the outlet 50 to prevent toner movement. In the open position, the opening 55 is aligned with the outlet 50 to allow toner movement. In one embodiment, the toner is moved from the outlet 50 in a direction towards the bottom 13.

Figure 6B:
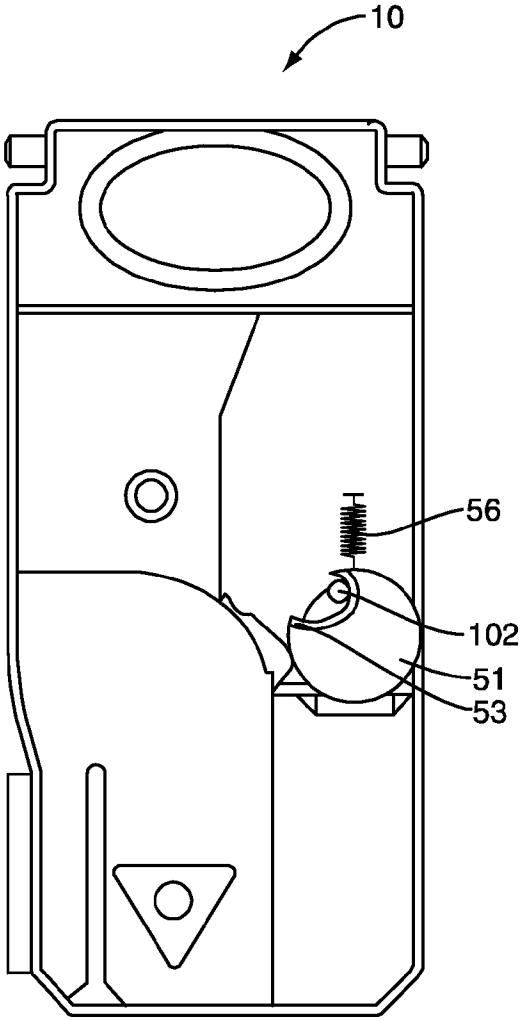
FIG. 6B is a side view of a shutter in an open position according to one embodiment.
Figure 6A:
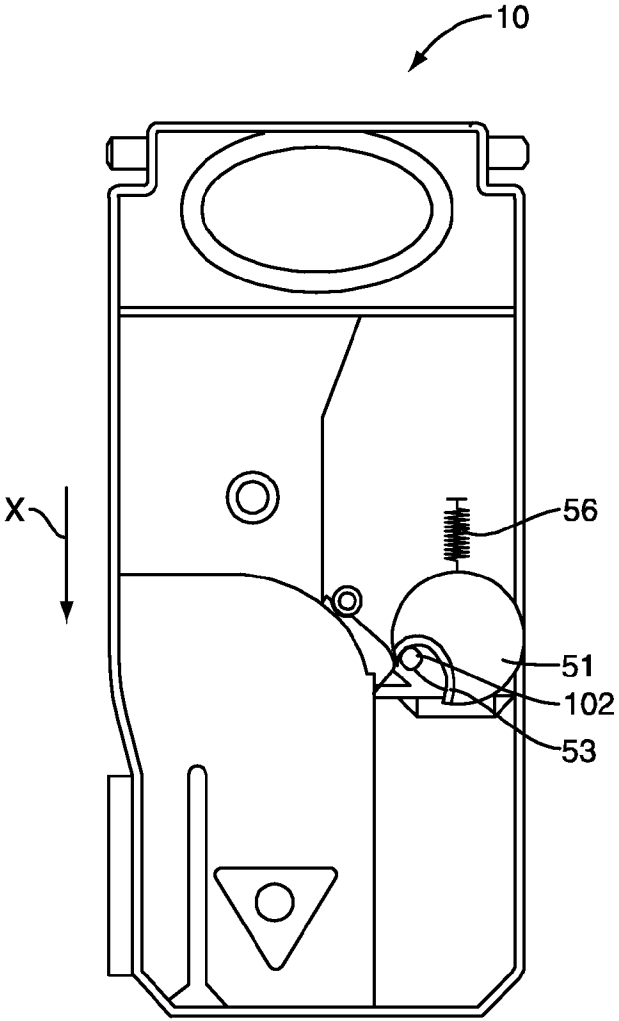
FIG. 6A is a side view of a shutter in a closed position according to one embodiment.
Figure 13:
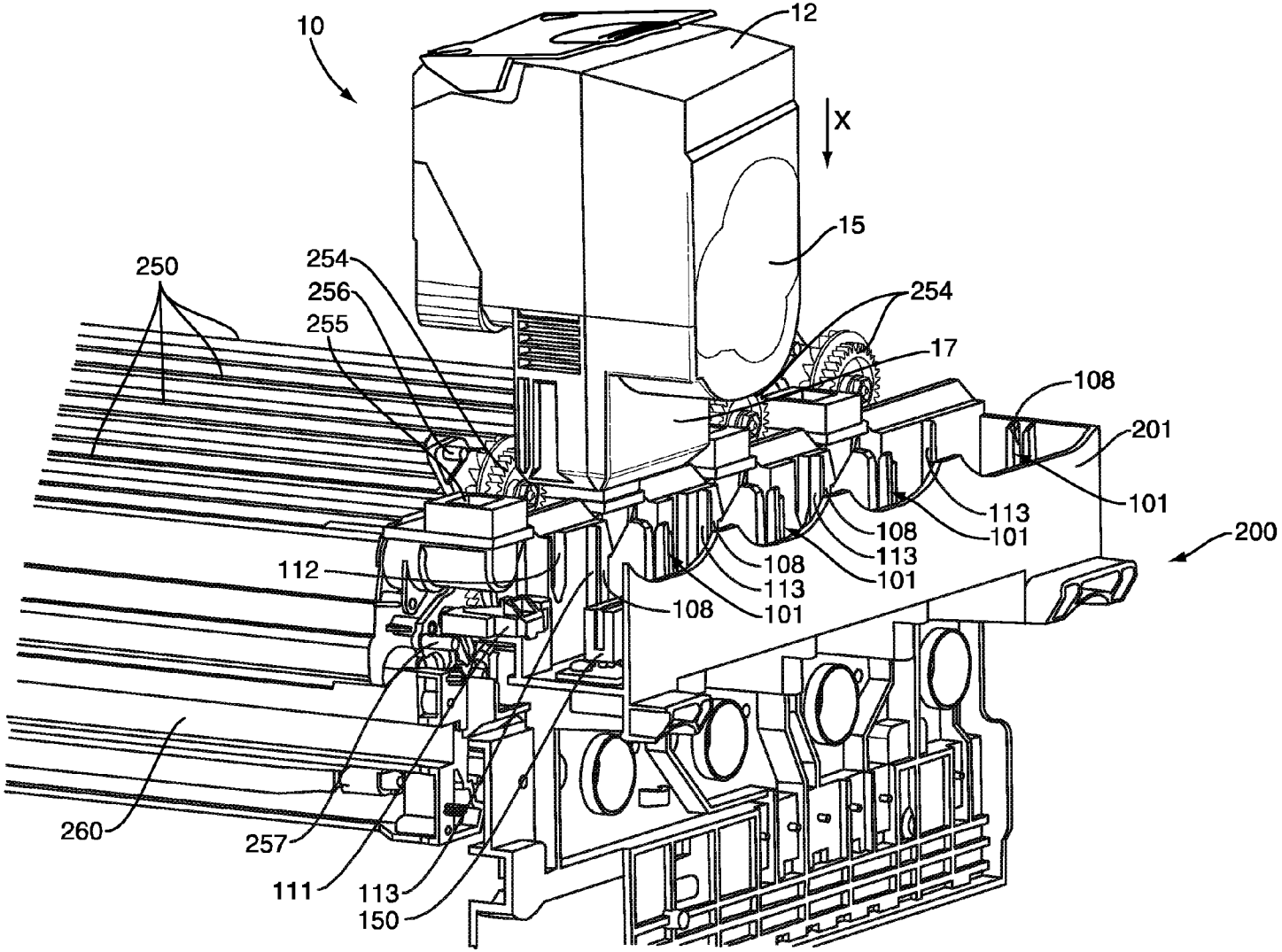
FIG. 13 is perspective view of a cartridge being inserted into an image forming device according to one embodiment.

FIG. 6A illustrates one embodiment of the shutter 51 in the closed orientation. A biasing member 56 is operatively attached to maintain the shutter 51 in the closed position. An engagement feature 102 in the image forming device 100 (specifically, a shutter actuation pin 256 as illustrated in FIG. 13) engages with the notch 53. During insertion of the cartridge 10 in the direction of arrow X into the image forming device 100, the notch 53 contacts against the feature 102. As the cartridge 10 continues to be inserted in the direction of arrow X, the force of the insertion overcomes the force of the biasing member 56 and causes the shutter 51 to rotate to the open position as illustrated in FIG. 6B. The shutter 51 remains in the open position until the cartridge 10 is removed from the device 100. The removal force causes the shutter 51 to contact the feature 102 and move to the closed position. One embodiment of a shutter is disclosed in U.S. Pat. No. 7,606,520, herein incorporated by reference.

Another functional engagement feature 11 is a drive gear 60 positioned on the front 14 of the cartridge 10. The drive gear 60 meshes with and receives rotational power from a corresponding gear in the image forming device 100. In the embodiment illustrated in FIG. 2, the drive gear 60 is partially covered with only a few teeth exposed.

The outlet 50 with the shutter 51 and the drive gear 60 are each positioned on the main section 38 of the cartridge 10. The outlet 50 is positioned below a center of the drive gear 60.

Figure 7:
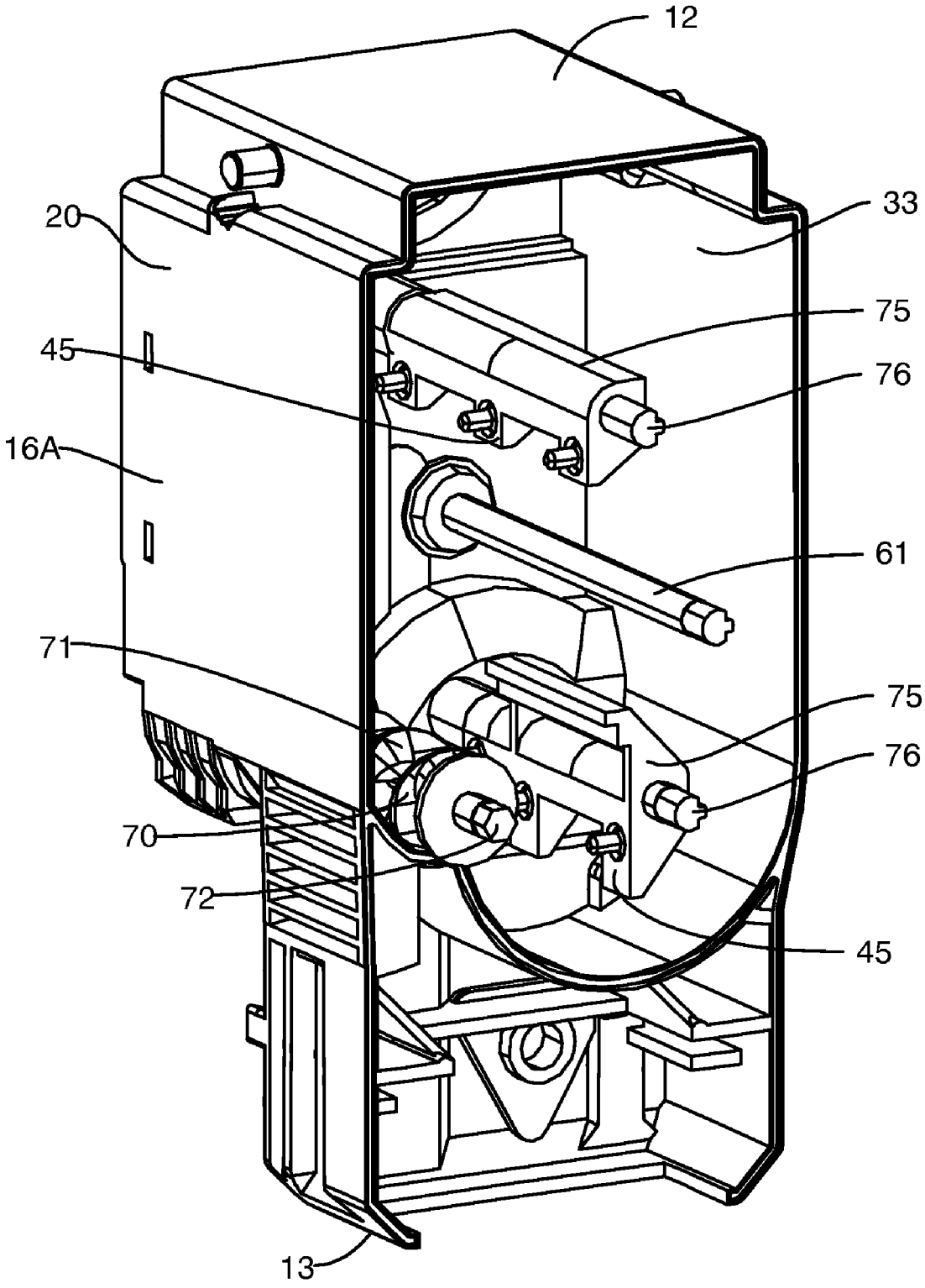
FIG. 7 is a perspective view of an interior of a cartridge according to one embodiment.

The drive gear 60 transfers power from the image forming device 100 to various elements on the cartridge 10. One element includes an auger 70 as illustrated in FIG. 7. The auger 70 is positioned within the interior 37 of the cartridge 10 to move the toner through the outlet 50. The auger 70 includes helical blades 71 that extend radially outwardly from a central shaft 72. Rotation of the auger 70 causes the toner to be moved by the blades 71 along the length and to the outlet 50.

One or more paddles 75 may also be positioned within the interior 37 to agitate the toner. Each of the paddles 75 includes a central shaft 76 that extends through the interior 37, and a blade (not illustrated) that extends outward from the central shafts 76. Rotation of the central shafts 76 causes the blades to rotate to prevent toner from becoming compressed together, and also move the toner towards the auger 70. In one embodiment, a wall is positioned within the interior 37 between the auger 70 and the paddles. Toner is moved from a first side of the wall by the paddles into a second side of the wall that includes the auger 70. The wall prevents the toner from moving away from the auger 70 to a lower section of the interior 37.

Figure 8:
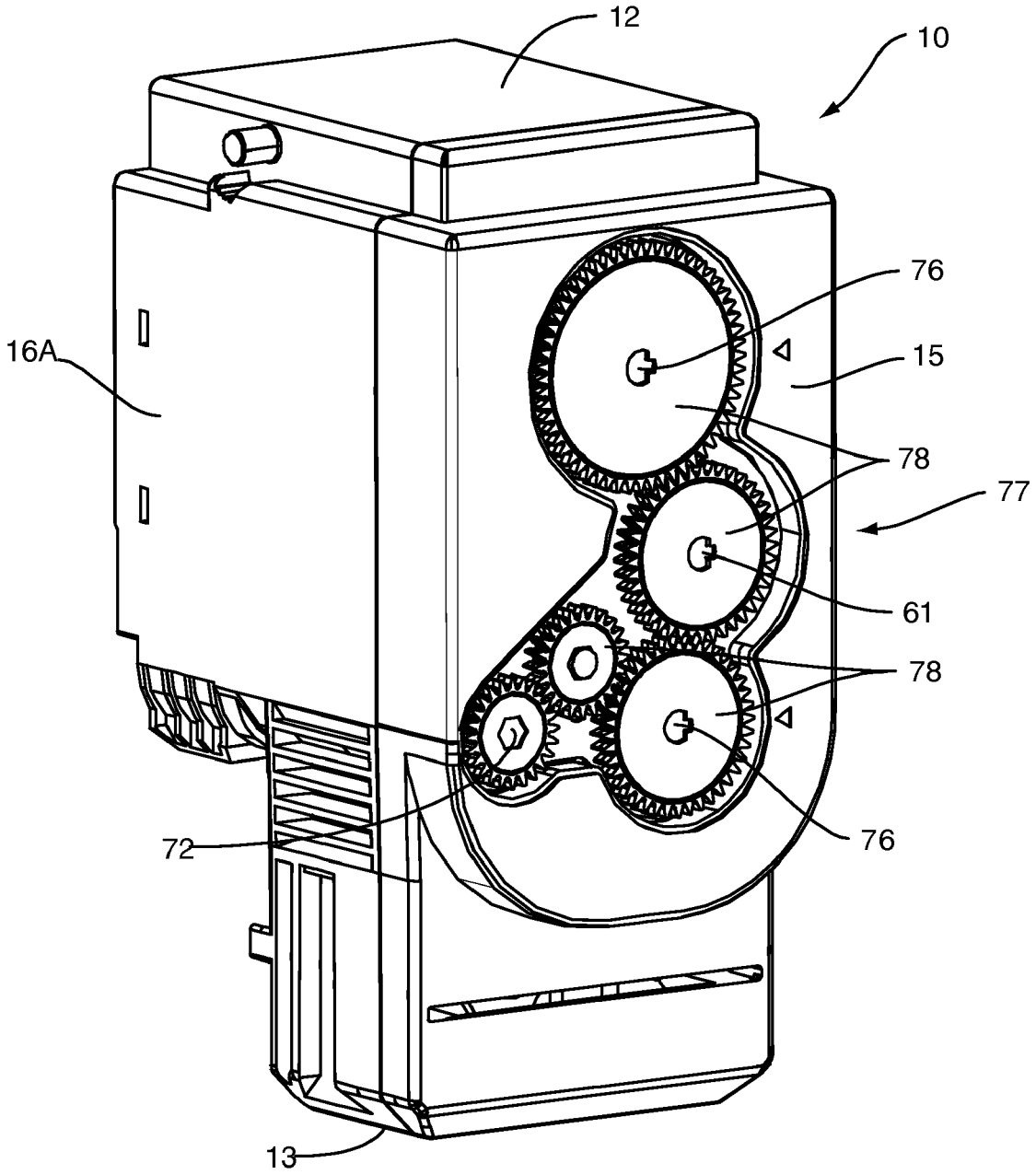
FIG. 8 is a perspective view of a drive train on a cartridge according to one embodiment.

A shaft 61 extends through the interior 37 and is operatively connected to the drive gear 60. The shaft 61 extends through the interior 37 and is operatively connected to a gear 78 as illustrated in FIG. 8. Gear 78 is part of a drive train 77 that is positioned on the back 15 of the cartridge 10. The drive train 77 includes gears 78 that are attached to the drive shaft 61, paddle shafts 76, and auger shaft 72. The rotation of the drive gear 60 is thus transferred through the drive shaft 61, and to the gears 78 for rotating each of the paddles 75 and the auger 70. The drive train 77 may also include one or more additional gears to interconnect gears 78. One embodiment of a drive train, paddles, auger, and drive gear 60 is disclosed in U.S. Pat. No. 7,672,624, herein incorporated by reference.

Figure 9:
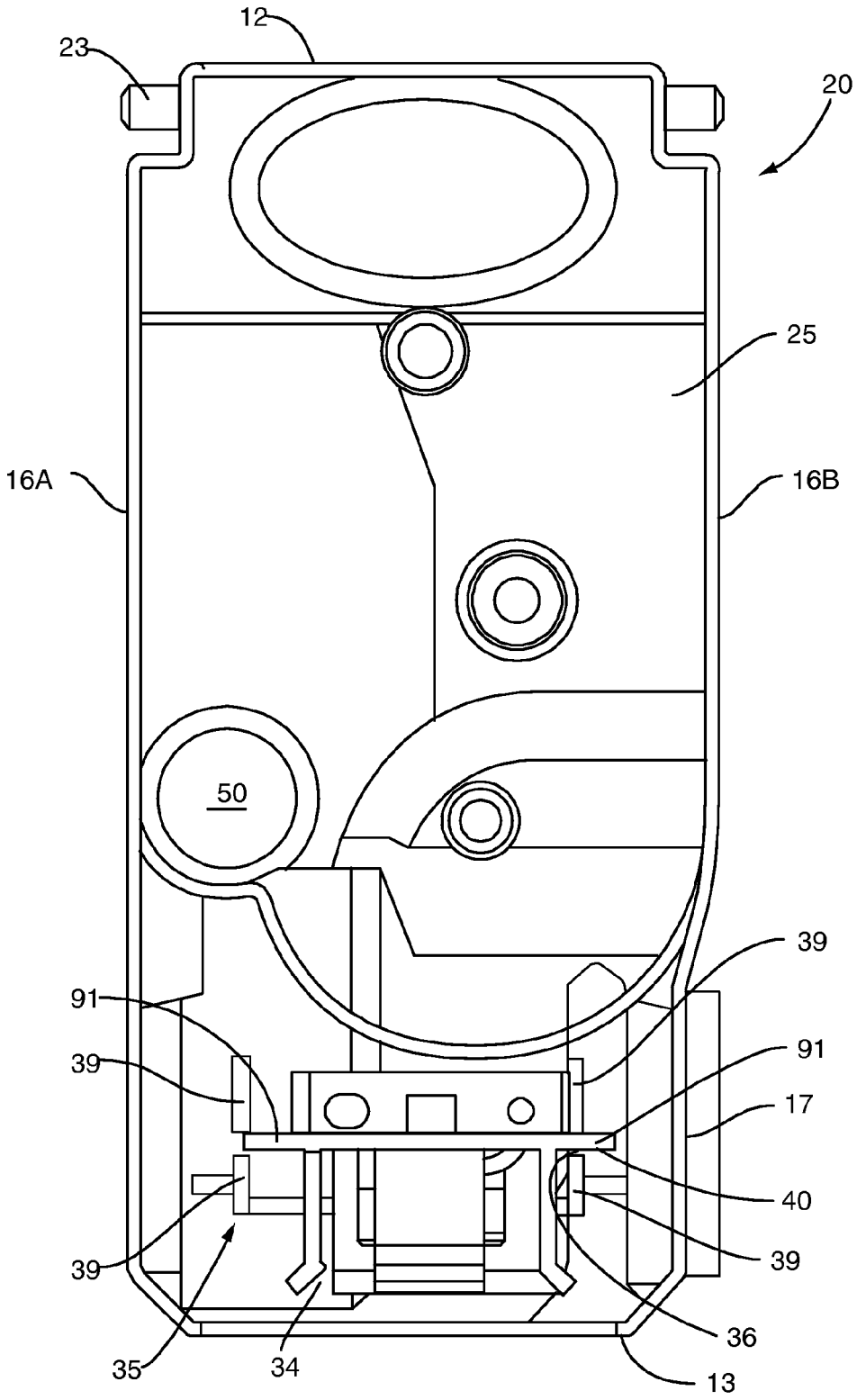
FIG. 9 is side schematic view of an electrical connector on a cartridge according to one embodiment.
Figure 10:
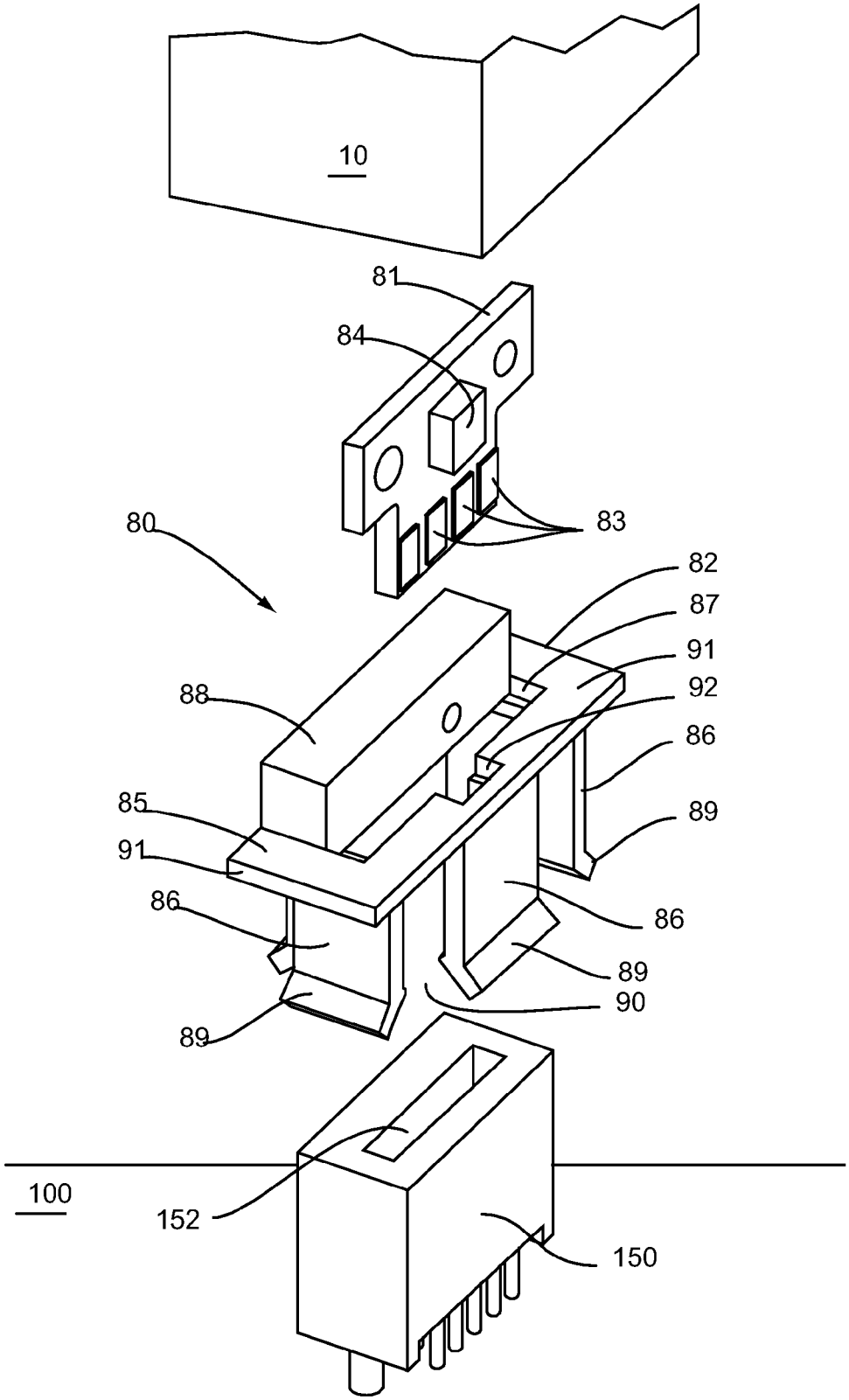
FIG. 10 is an exploded perspective view of an electrical connector according to one embodiment.

Another functional engagement feature 11 on the cartridge 10 includes an electrical connector 80 as illustrated in FIGS. 9 and 10. The electrical connector 80 forms a communication path between the cartridge 10 and the image forming device 100. In this embodiment, the electrical connector 80 is positioned within a cavity 34 at the bottom 13 of the cartridge 10. In one specific embodiment, the electrical connector 80 is positioned within the extension 17. The electrical connector 80 may be positioned completely or partially within the cavity 34. A retainer 35 is positioned within the cavity 34 to retain the electrical connector 80. The retainer 35 may be formed as a unitary part of the cartridge 10, or may be a separate element that is attached to the cartridge 10. The retainer 35 includes a slot 36 formed between a pair of spaced apart members 39.

FIG. 10 illustrates an exploded view of an electrical connector 80 that includes a circuit board 81 and a housing 82. The circuit board 81 includes one or more electrical contacts 83. The circuit board 81 may further include computing hardware, schematically illustrated as 84, for storing cartridge parameters including but not limited to pages printed, toner color, first use date, and cartridge ID. The computing hardware 84 may include one or more processors, logic devices, and memory. The computing hardware may further comprise integrated circuits, including for example application specific integrated circuits and digital signal processors, in which embedded program code may be stored and executed.

Housing 82 is constructed to position the circuit board 81 for engaging with a connector 150 within the image forming device 100. Housing 82 includes a base 85 with one or more outwardly-extending arms 86. Base 85 includes an opening 87 sized to receive the circuit board 81. A member 88 may be positioned adjacent to the opening 87 to support the circuit board 81 when attached to the housing 82. In one embodiment, opening 87 includes a notch 92 sized to receive the computing hardware 84 when the circuit board 81 is connected to the housing 82.

One or more arms 86 extend outward from the base 85 in a cantilever manner. The arms 86 may be rigid or may be flexible relative to the base 85. In one embodiment, four arms extend from the base 85 and each is flexible. In another embodiment, multiple arms 86 extend from the base 85 with one or more of the arms 86 being flexible and the others being rigid. The arms 86 form a receptacle 90 sized to extend around the entirety or a portion of the connector 150. One or more of the arms 86 may further include a flared end 89 to facilitate engagement with the connector 150 of the image forming device 100. Arms 86 may include a variety of shapes and configurations. The housing 82 may further include wings 91 that laterally extend outward to fit within the slot 36 in the retainer 35. The electrical connector 80 may be fixedly or movably attached to the cartridge 10. Embodiments of electrical connectors are disclosed in U.S. Pat. Nos. 7,258,558 and 7,272,336, each herein incorporated by reference.

One or more datum points are positioned to provide the proper alignment of the cartridge 10 within the image forming device 10. The datum points align the cartridge 10 along multiple dimensions during insertion into the image forming device 100. A first datum point is formed at the second end 30A of the alignment slot 28A. A second datum point is formed along the edge 32A of the slot 28A on the side 16A of the extension 17. A third datum point includes a centerline of the alignment slot 28B on the front 14 of the extension 17.

Figure 11:
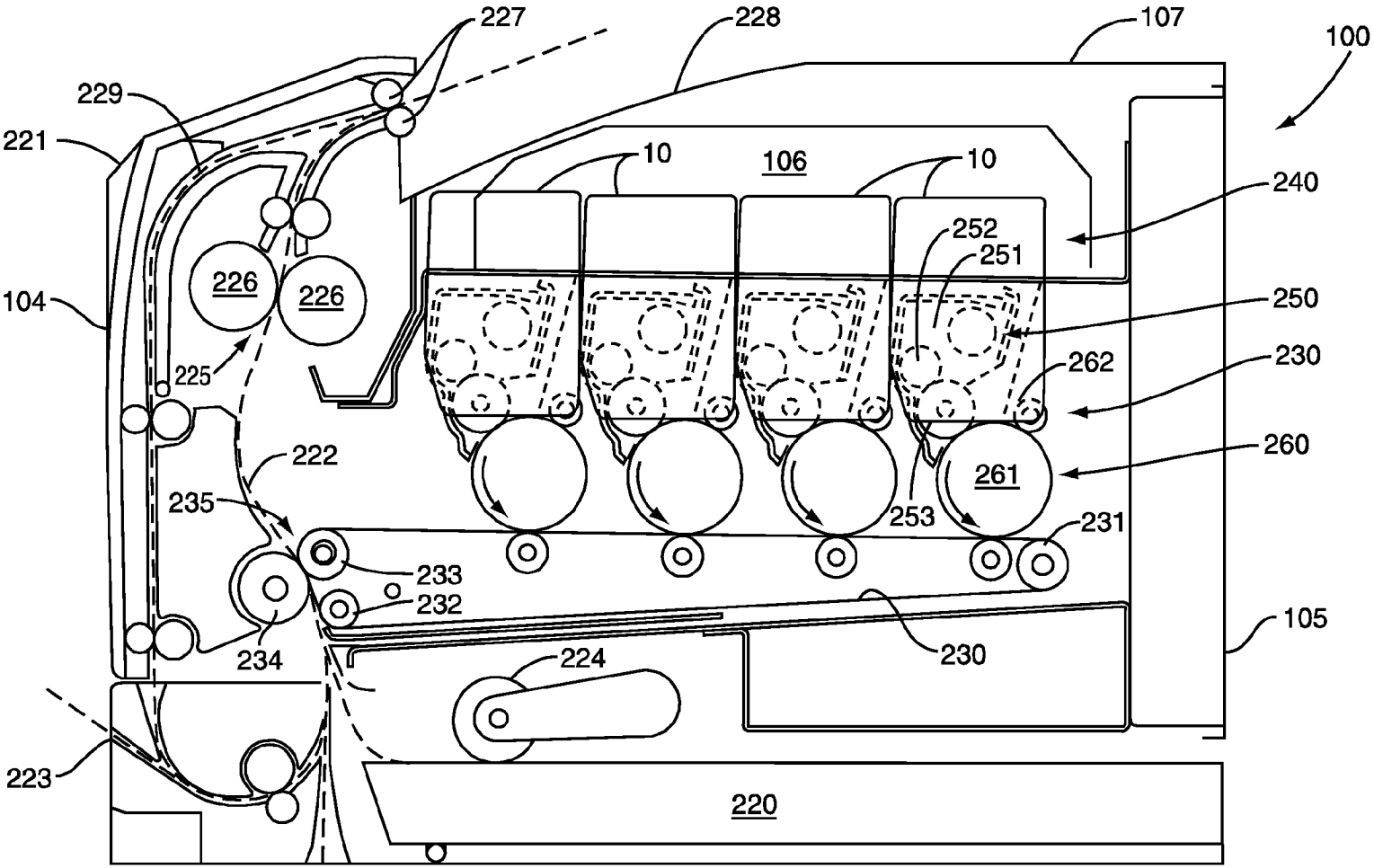
FIG. 11 is a side schematic view of an image forming device according to one embodiment.

The cartridge 10 is mounted within the image forming device 100 to transfer the toner for forming an image on a media sheet. After exiting the cartridge 10, the toner moves through a developer unit 250 and a photoconductive (PC) unit 260. As the toner is moving through these elements, a media sheet is being delivered to receive the toner. FIG. 11 illustrates on embodiment of an image forming device 100 with toner cartridges 10.

A first toner transfer area 230 includes one or more imaging stations 240 that are aligned horizontally extending from the front 104 to the back 105 of the image forming device 100. Each imaging station 240 includes a cartridge 10, a developer unit 250, and a photoconductive unit 260. Each of the imaging stations 240 is mounted such that photoconductive (PC) drums 261 are substantially parallel. For purposes of clarity, the units 250, 260 are labeled on only one of the imaging stations 240. In one embodiment, each of the imaging stations 240 is substantially the same except for the color of toner.

The developer unit 250 includes a toner reservoir 251 to contain the toner. One or more agitating members may further be positioned within the reservoir 251 to move the toner. Developer unit 250 further includes a toner adder roll 252 that moves the toner supplied from the reservoir 251 to a developer roll 253. The photoconductive unit 260 includes in part a charging roll and the PC drum 261.

The charging roll 262 forms a nip with the PC drum 261, and charges the surface of the PC drum 261 to a specified voltage such as −1000 volts, for example. A laser beam from a printhead 106 is directed to the surface of the PC drum 261 and discharges those areas it contacts to form a latent image. In one embodiment, areas on the PC drum 261 illuminated by the laser beam are discharged to approximately −300 volts. The developer roll 253, which is coated with toner, forms a nip with the PC drum 261, then transfers toner to the PC drum 261 to form a toner image. A metering device such as a doctor blade assembly can be used to meter toner onto the developer roll prior to its transfer to the PC drum. The toner is attracted to the areas of the PC drum 261 surface discharged by the laser beam from the printhead 106.

An intermediate transfer mechanism (ITM) 230 is disposed adjacent to each of the imaging stations 240. In this embodiment, the ITM 230 is formed as an endless belt trained about drive roll 231, tension roll 232 and back-up roll 233. During image forming operations, the ITM 230 moves past the imaging stations 240 in a clockwise direction as viewed in FIG. 11. One or more of the PC drums 261 apply toner images in their respective colors to the ITM 230. In one embodiment, a positive voltage field attracts the toner image from the PC drums 261 to the surface of the moving ITM 230.

The ITM 230 rotates and collects the one or more toner images from the imaging stations 240 and then conveys the toner images to a media sheet at a second transfer area. The second transfer area includes a second transfer nip 235 formed between the back-up roll 233 and a second transfer roll 234.

Media sheets may originally be stored in a media input tray 220 positioned in a lower section of the device 100. The tray 220 is sized to contain a stack of media sheets that will receive color and/or monochrome images. The media input tray 220 is preferably removable for refilling. A control panel 221 may be located on the front 104 of the device 100. Using the control panel 221, the user is able to enter commands and generally control the operation of the image-forming device 100. For example, the user may enter commands to switch modes (e.g., color mode, monochrome mode), view the number of images printed, take the device 100 on/off line to perform periodic maintenance, and the like.

A media path 222 extends through the device 100 for moving the media sheets through the imaging process. Media sheets are initially stored in the input tray 220 or introduced through a manual feed 223. The sheets in the input tray 220 are picked by a pick mechanism 224 and moved into the media path 222. In this embodiment, the pick mechanism 224 includes a roll positioned at the end of a pivoting arm. The roll rotates to move the media sheets from input tray 220 towards the second transfer area. In one embodiment, the pick mechanism 224 is positioned in proximity (i.e., less than a length of a media sheet) to the second transfer area with the pick mechanism 224 moving the media sheets directly from the input tray 220 into the second transfer nip 235. For sheets entering through the manual feed 223, one or more rolls are positioned to move the sheet into the second transfer nip 235.

The media sheet receives the toner image from the ITM 230 as it moves through the second transfer nip 235. The media sheets with toner images are then moved along the media path 222 and into a fuser area 225. Fuser area 225 includes fusing rolls or belts 226 that form a nip to adhere the toner image to the media sheet. The fused media sheets then pass through exit rolls 227 that are located downstream from the fuser area 225. Exit rolls 227 may be rotated in either forward or reverse directions. In a forward direction, the exit rolls 227 move the media sheet from the media path 222 to an output area 228 at a top 107 of the device 100. In a reverse direction, the exit rolls 227 move the media sheet into a duplex path 229 for image formation on a second side of the media sheet.

Figure 12A:
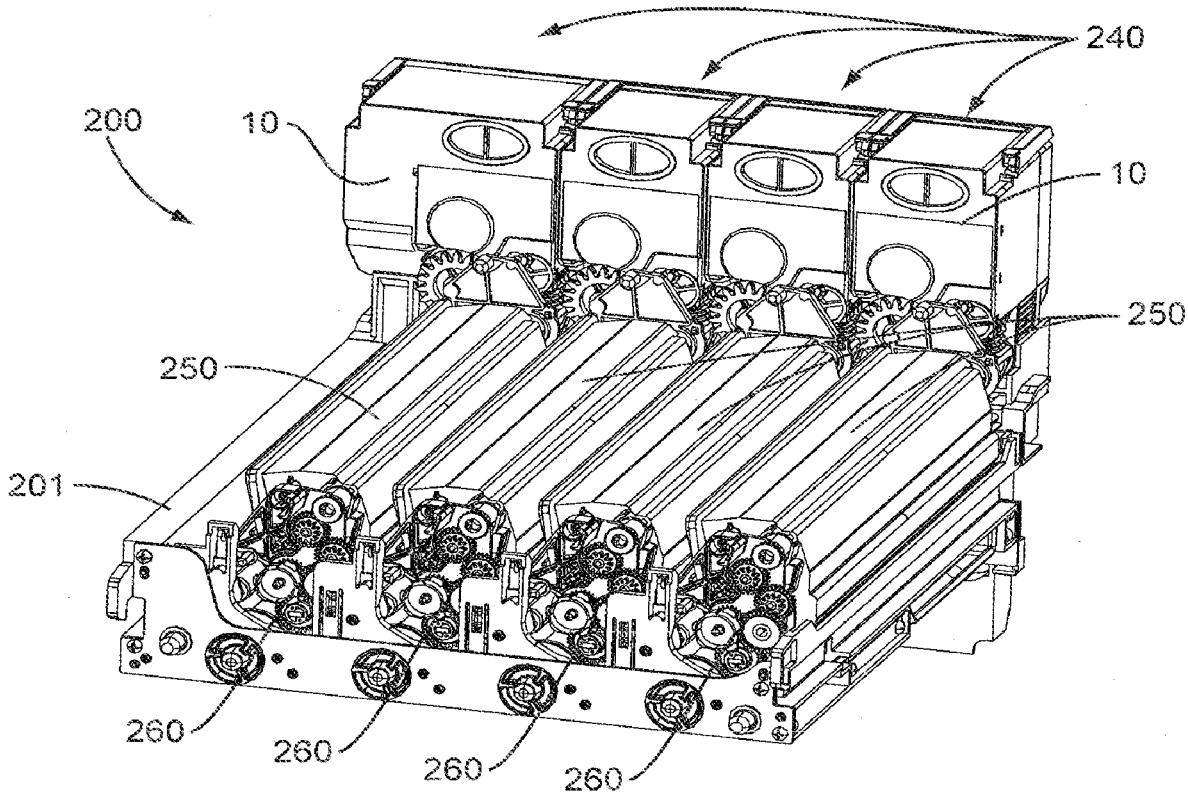
FIG. 12A is a perspective view of a first side of an imaging unit according to one embodiment.
Figure 12B:
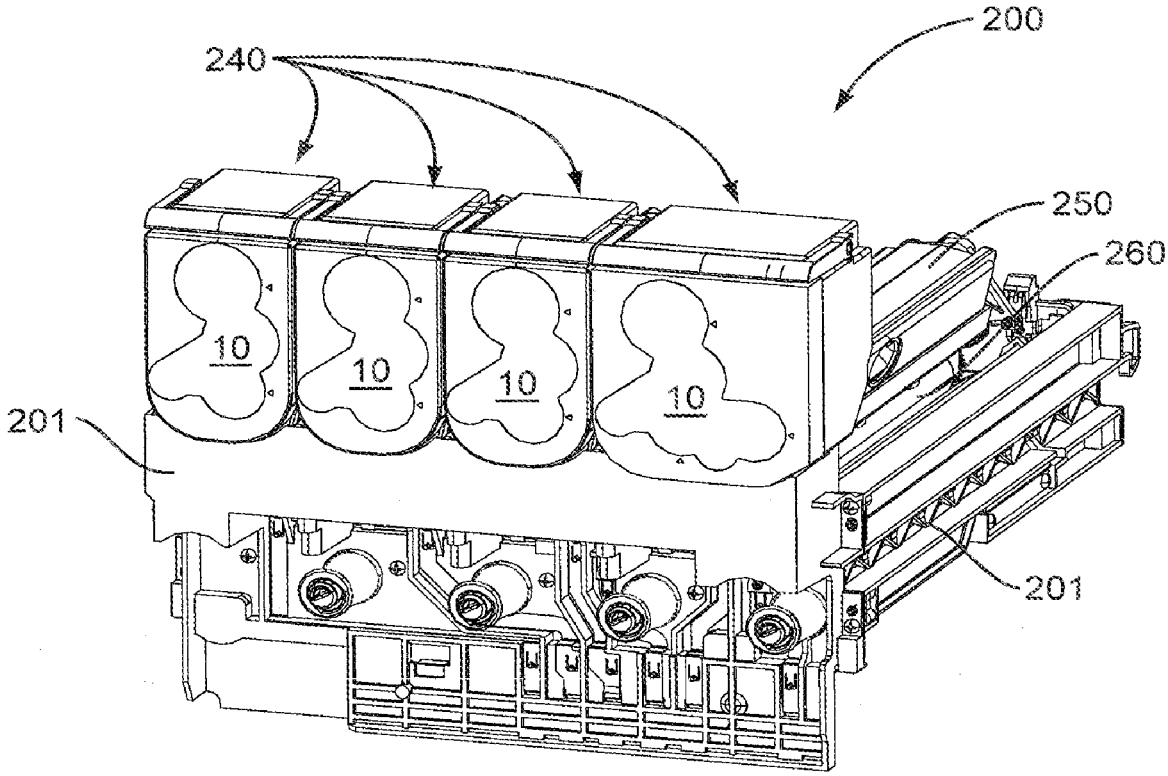
FIG. 12B is a perspective view of a second side of an imaging unit according to one embodiment.

A monocolor image forming device 100 may include a single imaging station 240, as compared to a color image forming device 100 that may include multiple imaging stations 240. FIGS. 12A and 12B illustrate an imaging unit 200 that includes four imaging stations 240 that each includes a cartridge 10, a developer unit 250, and a PC unit 260. The imaging unit 200 includes a frame 201 sized to receive each of the imaging stations 240. In one embodiment, the frame 201 is manufactured out of stamped metal plates that result in precise control of the location of the PC drums 261 relative to one another and relative to the belt of ITM 230, laser printhead 106, and drive modules within the device 100. Frame 201 includes a central opening sized to receive the developer units 250 and photoconductive units 260. One embodiment of the imaging units, imaging stations, developer units, and PC units is disclosed in U.S. Pat. No. 7,831,168, herein incorporated by reference.

FIGS. 13-17 illustrate embodiments of a cartridge 10 being inserted into an imaging unit 200. For purposes of clarity, only a single cartridge 10 is illustrated as being inserted into the imaging unit 200 with the other cartridges 10 removed for clarity. As illustrated in FIG. 13, the cartridge 10 is inserted in a vertical direction indicated by arrow X. The vertical direction provides for the cartridge 10 to be inserted from the top 107 of the image forming device 10. In one embodiment, the top 107 includes a door that provides access to each of the cartridges 10. Each cartridge 10 may be removed and replaced independently without removing any of the developer units 250, PC units 260, or the imaging unit 200.

Receiving areas 101 are aligned along the frame 201 of the imaging unit 200 each sized to receive one of the cartridges 10. In this embodiment, four receiving areas 101 are horizontally aligned along the frame 201. Each of the receiving areas 101 is positioned adjacent to one of the developer units 250 and PC units 260. A wall 112 may separate a portion of the receiving area 101 that receives the extension 17 from the developer unit 250 and PC unit 260. Once fully inserted, the front shelf 25 (See FIG. 4) is positioned above the wall 112. The frame 201 further includes a cut-out section that is positioned under the back shelf 26.

The receiving area 101 includes one or more engagement features 102 to engage with the cartridge engagement features 11 during insertion. The engagement features 102 include: an inlet 255 positioned to receive the toner from the cartridge outlet 50; a gear 254 that extends upward to mesh with the cartridge drive gear 60; a shutter actuation pin 256 that extends outward from the developer unit 250 to engage with the notch 53 to rotate the shutter 51; the electrical connector 150 that connects with the cartridge electrical connector 80; one or more guideways 108 that engage with the ribs 19; and an angled surface 109.

FIG. 13 illustrates the cartridge 10 at the beginning of insertion into the receiving area 101. At this point, the cartridge 10 is not in contact with any other elements and is spaced away from the developer unit 250 and the frame 201.

Figure 14:
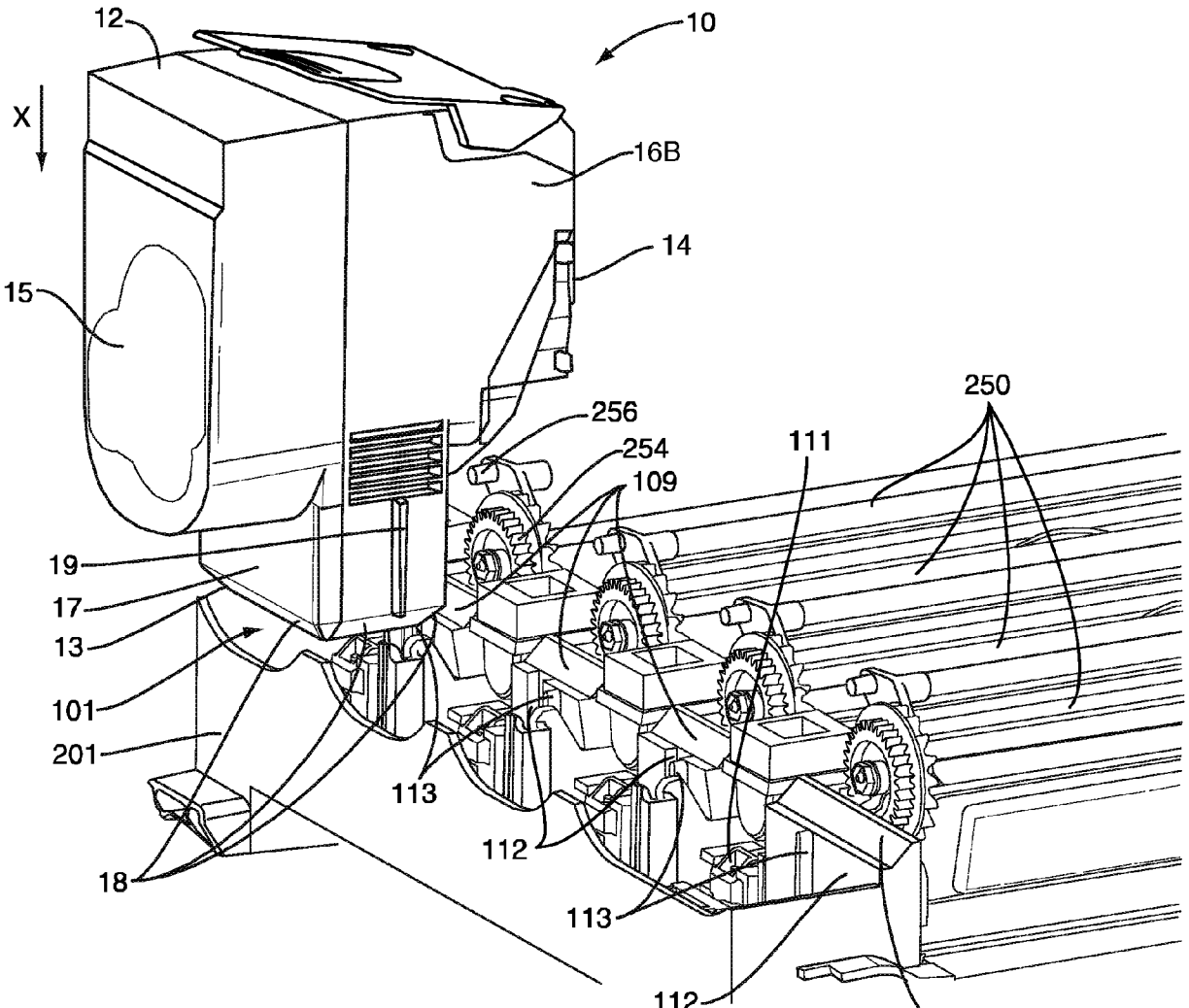
FIG. 14 is perspective view of a cartridge being inserted into an image forming device according to one embodiment.

FIG. 14 illustrates the cartridge 10 after a further amount of insertion into the image forming device 100. The cartridge 10 initially contacts the angled surface 109 positioned on the wall 112 to begin the alignment into the receiving area 101. Specifically, the chamfer edge 18 that faces the front 14 contacts against the angled surface 109. In one embodiment, this contact occurs when the cartridge 10 is about 32 mm from complete insertion. The lockout mechanism 33 engages after the chamfer edges 18 align the cartridge 10. The lockout mechanism 33 allows for insertion of the cartridge 10 in the correct receiving area 101, and prevents further insertion in an incorrect receiving area 101.

Figure 15:
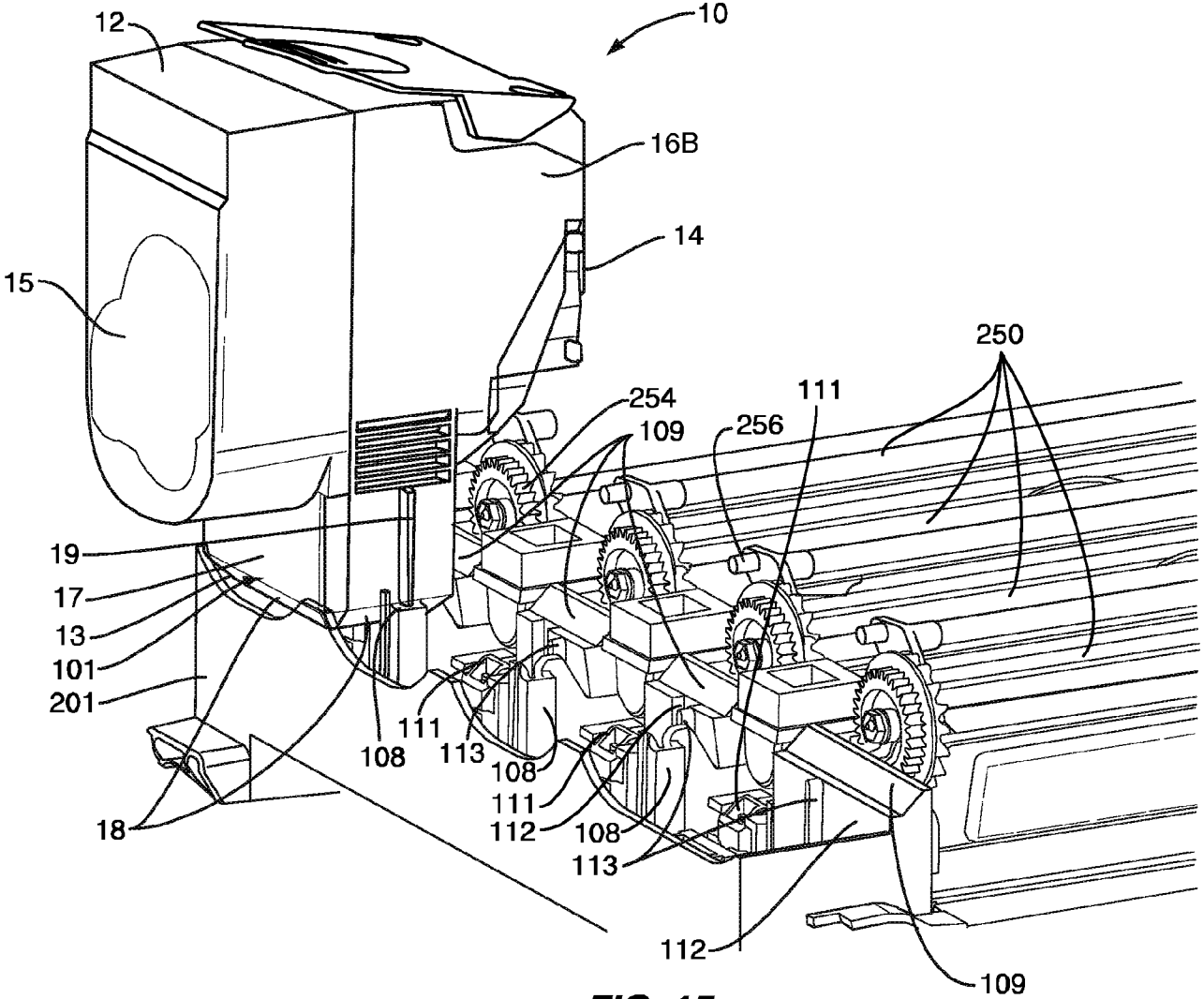
FIG. 15 is perspective view of a cartridge being inserted into an image forming device according to one embodiment.

FIG. 15 illustrates the cartridge 10 after an additional amount of insertion into the image forming device 100. In one embodiment, FIG. 15 illustrates the cartridge about 24 mm from complete insertion. Ribs 19 on the first and second lateral sides 16A, 16B of the extension 17 begin to engage with the guideways 108 (only second side 16B is visible in FIG. 15). The guideways 108 may include an enlarged opening to facilitate engagement with the extension 17. Slot 28B on the front 14 of the extension 17 may engage with ribs 113 that extend along the wall 112. In one embodiment, engagement and contact with the alignment features 11 align the cartridge 10 relative to the receiving area 101. This aspect occurs prior to engagement and contact with the functional features 11.

After a predetermined amount of insertion, the chamfer edge 18 that faces the front 14 contacts a retainer 111 on the frame 201. This contact causes the retainer 111 to slide relative to the frame 201 away from the receiving area 101 and extend over a section of the developer unit 250. In one embodiment, the retainer 111 moves over a post 257 that extends outward from the developer unit 250. Examples of a retainer are disclosed in U.S. Pat. No. 7,953,347, which is incorporated herein by reference.

As the cartridge 10 continues insertion, the notch 53 on the shutter 51 contacts against the actuation pin 256 on the developer unit 250. Continued insertion causes the shutter 51 to rotate from the closed position to the open position. Prior to the shutter 51 moving to the open position, the outlet 50 on the cartridge 10 aligns with an inlet 255 on the developer unit 250. When the shutter 51 moves to the open position, any toner expelled through the outlet 50 is received in the inlet 255.

Figure 16:
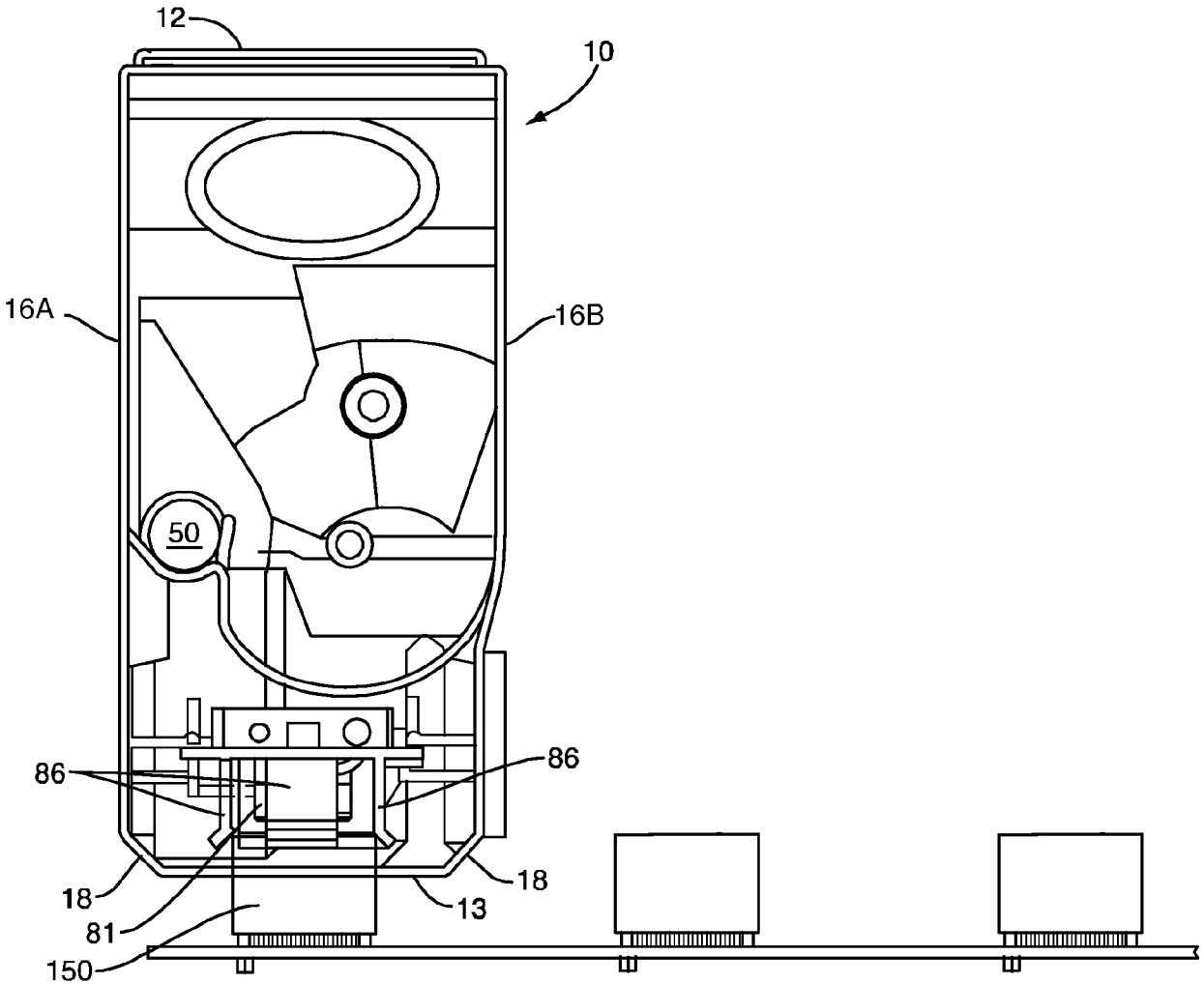
FIG. 16 is a side schematic view of an electrical connector on a cartridge engaging with an electrical connector on an image forming device according to one embodiment.

FIG. 16 illustrates one embodiment with the cartridge 10 nearing full insertion. In one embodiment, this includes the cartridge 10 being about 10 mm from full insertion. The electrical connector 80 on the cartridge 10 begins to engage with the electrical connector 150. The flared ends of the arms 86 initially contact against the connector 150 and align the connector 80. As insertion continues, the arms 86 center about the connector 150 and move vertically along the outer sides. The connector 80 maybe movably attached to the cartridge 10 to facilitate the alignment relative to the connector 150. Upon full insertion, the circuit board 81 inserts within the opening 152 (see FIG. 10). Insertion also causes the drive gear 60 to engage with a gear 254 on the developer unit 250. The teeth on the drive gear 60 intermesh with the teeth on the gear 254.

Figure 17:
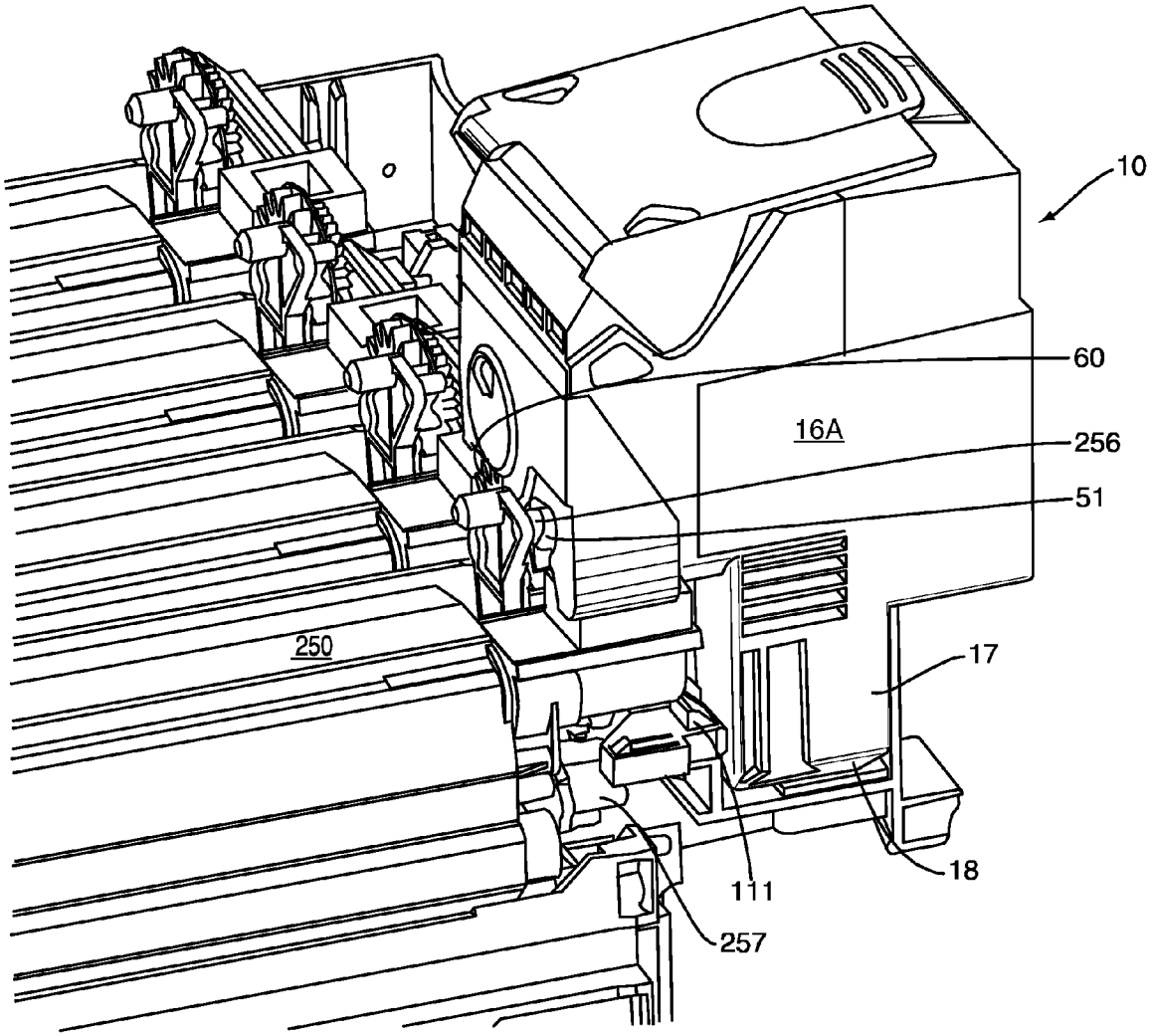
FIG. 17 is perspective view of a cartridge fully inserted into an image forming device according to one embodiment.

FIG. 17 illustrates the cartridge 10 fully inserted into the image forming device 100. The shutter 51 is in the open position to allow toner to move through the outlet 50. The drive gear 60 is engaged with the gear 254 on the developer unit 250 to provide rotational power to the cartridge 10. The electrical connector is fully seated within the connector 150 to allow communication.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A toner cartridge for use with an image forming device comprising:

a body including an interior to contain toner and comprising a main section and an extension that extends outward from the main section and includes a smaller depth than the main section, the body including a top positioned on the main section, a bottom positioned on the extension, and a front, back, and first and second lateral sides positioned on each of the main section and the extension;

at least one chamfer positioned on the bottom of the extension to align the body during insertion into the image forming device;

a rib positioned on the first lateral side of the extension and including a leading edge that faces towards the bottom and is spaced away from bottom;

an outlet positioned on the front of the main section to allow the toner to be moved from the interior and into the image forming device, the outlet positioned a greater distance from the bottom of the extension than the rib;

a shutter operatively connected to the outlet and movable between a closed position to prevent the toner from moving through the outlet and an open position to allow the toner to move through the outlet;

a drive gear positioned on the front of the main section to engage with the image forming device, a center of the drive gear positioned farther from the bottom than the outlet;

a cover attaching to the main section and extending across a majority of a face of the drive gear, with a lower section of the drive gear extending toward the bottom and beyond the cover for receiving rotational power from a corresponding gear in the image forming device;

a first slot positioned adjacent to the rib on the first lateral side of the extension, the first slot including first and second parallel side walls, an open end that faces towards the bottom and a closed end opposite the open end; and a second slot positioned in the front of the extension with an open end that faces the bottom, the second slot including first and second opposing side walls, wherein (1) the closed end of the first slot, (2) one of the first and second side walls of the first slot and (3) a centerline of the second slot form a first, a second and a third datum, respectively, for aligning the toner cartridge when fully inserted in the image forming device.

2. A toner cartridge for use with an image forming device comprising:

a body with a top, bottom, front, first and second lateral sides, and a back, the body also including an enclosed interior to contain toner;

at least one chamfer positioned at the bottom to align the cartridge during insertion into the image forming device;

a rib positioned on the first lateral side to laterally position the cartridge during insertion into the image forming device, the rib including a leading edge, the leading edge facing towards the bottom and being spaced away from the bottom;

an outlet in the body to allow the toner to be moved from the interior and into the image forming device, the outlet positioned a greater distance from the bottom than the rib;

a shutter operatively connected to the outlet and movable between a closed position to prevent the toner from moving through the outlet and an open position to allow the toner to move through the outlet;

a drive gear positioned on the front of the body for engaging with the image forming device, a center of the drive gear being positioned farther from the bottom than the outlet;

a cover that attaches to the front of the body and extends across a majority of a front face of the drive gear, a lower section of the drive gear being positioned toward the bottom and extending beyond the cover for receiving rotational power from a corresponding gear in the image forming device;

a drive train positioned on the back and operatively connected to the drive gear, the drive train comprising a plurality of gears that drive elements positioned within the interior of the body;

a first slot positioned in the front with an open end that faces the bottom, the first slot including first and second opposing side walls; and a second slot positioned in one of the first and second lateral sides, the second slot being wider than the first slot.

3. The cartridge of claim 2, wherein the outlet is positioned on the front of the body.

4. The cartridge of claim 2, further comprising a cavity that extends into the body from the bottom and is sized to contain an electrical connector.

5. The cartridge of claim 2, further comprising a lockout mechanism positioned on the front of the body adjacent to the bottom, the lockout mechanism preventing improper insertion of the cartridge into the image forming device.

6. The cartridge of claim 2, further comprising an auger positioned within the interior and operatively connected to the drive train, the auger receiving rotational power from the drive gear to move toner through the outlet.

7. The cartridge of claim 6, wherein the auger is positioned in closer proximity to the bottom than the center of the drive gear.

8. A toner cartridge for use with an image forming device comprising:

a body with a top, bottom, front, first and second lateral sides, and a back, the body also including an enclosed interior to contain toner;

at least one chamfer positioned at the bottom to align the cartridge during insertion into the image forming device;

a rib positioned on the first lateral side to laterally position the cartridge during insertion into the image forming device, the rib including a leading edge, the leading edge facing towards the bottom and being spaced away from the bottom;

an outlet in the body to allow the toner to be moved from the interior and into the image forming device, the outlet positioned a greater distance from the bottom than the rib;

a shutter operatively connected to the outlet and movable between a closed position to prevent the toner from moving through the outlet and an open position to allow the toner to move through the outlet;

a drive gear positioned on the front of the body for engaging with the image forming device, a center of the drive gear being positioned farther from the bottom than the outlet;

a cover that attaches to the front of the body and extends across a majority of a front face of the drive gear, a lower section of the drive gear being positioned toward the bottom and extending beyond the cover for receiving rotational power from a corresponding gear in the image forming device;

a first slot positioned in the front with an open end that faces the bottom, the first slot including first and second opposing side walls; and a second slot positioned in one of the first and second lateral sides, the second slot being wider than the first slot, the second slot including an open end that faces the bottom, a closed end opposite the open end and first and second opposing side walls that extend between the open end and the closed end, wherein (1) the closed end of the second slot, (2) one of the first and second side walls of the second slot and (3) a centerline of the first slot form a first, a second and a third datum, respectively, for aligning the toner cartridge when fully inserted in the image forming device.

9. The cartridge of claim 8, wherein the outlet is positioned on the front of the body.

10. The cartridge of claim 8, further comprising a cavity that extends into the body from the bottom and is sized to contain an electrical connector.

11. The cartridge of claim 8, further comprising a lockout mechanism positioned on the front of the body adjacent to the bottom, the lockout mechanism preventing improper insertion of the cartridge into the image forming device.

12. The cartridge of claim 8, further comprising a drive train positioned on the back and operatively connected to the drive gear, the drive train comprising a plurality of gears that drive elements positioned within the interior of the body.

13. The cartridge of claim 12, further comprising an auger positioned within the interior and operatively connected to the drive train, the auger receiving rotational power from the drive gear to move toner through the outlet.

14. The cartridge of claim 13, wherein the auger is positioned in closer proximity to the bottom than the center of the drive gear.

15. A toner cartridge for use with an image forming device comprising:

a main section having an interior cavity to contain toner;

an extension that extends outward from the main section, the extension including a smaller depth than the main section and a bottom that faces away from the main section, the extension having a front, two lateral sides, and a back, the extension positioned towards the image forming device during insertion of the toner cartridge;

at least one chamfer edge positioned at the bottom to align the cartridge during insertion into the image forming device;

a rib positioned on one of the two lateral sides of the extension and in proximity to the bottom to position the cartridge during insertion into the image forming device;

an outlet on the main section through which the toner is moved into the image forming device;

a shutter operatively connected to the outlet and movable between a closed position to prevent the toner from moving through the outlet and an open position to allow the toner to move through the outlet;

a drive gear positioned on the main section above the outlet to engage with the image forming device;

a cover attaching to the main section and extending across a majority of a face of the drive gear, with a lower section of the drive gear extending toward the bottom and beyond the cover for receiving rotational power from a corresponding gear in the image forming device;

a first slot positioned in the front of the extension having an open end that faces towards the bottom, the first slot including first and second opposing side walls; and a second slot positioned adjacent to the rib, the second slot including first and second parallel side walls, an open end that faces towards the bottom, and a closed end opposite the open end, wherein (1) the closed end of the second slot, (2) one of the first and second side walls of the second slot and (3) a centerline of the first slot form a first, a second and a third datum, respectively, for aligning the toner cartridge when fully inserted in the image forming device.

16. The cartridge of claim 15, wherein the main section further includes a front shelf and a back shelf that are each substantially perpendicular to the extension.

17. The cartridge of claim 15, wherein the extension is positioned at a central point along the depth of the main section.

18. The cartridge of claim 15, further comprising a second cavity positioned within the extension, the second cavity including a height that extends from the bottom to an inner side of the main section.

19. The cartridge of claim 18 further comprising an electrical connector positioned within the second cavity, the electrical connector including a housing operatively connected to the extension and a circuit board.

20. The cartridge of claim 15, wherein the main section includes a greater height than the extension.

21. The cartridge of claim 15, further comprising an auger positioned within the main section and being operatively connected to the drive gear with rotation of the auger moving toner through the outlet.

* * * * *